US007762160B2

(12) United States Patent
Basler et al.

(10) Patent No.: US 7,762,160 B2
(45) Date of Patent: Jul. 27, 2010

(54) POWER TONG CAGE PLATE LOCK SYSTEM

(75) Inventors: Hermann Basler, Stony Plain (CA); Jason Giebelhaus, Edmonton (CA)

(73) Assignee: McCoy Corporation, Edmonton, Alberta (CA)

( * ) Notice: Subject to any disclaimer, the term of this patent is extended or adjusted under 35 U.S.C. 154(b) by 0 days.

(21) Appl. No.: 11/767,663

(22) Filed: Jun. 25, 2007

(65) Prior Publication Data

US 2008/0000330 A1 Jan. 3, 2008

Related U.S. Application Data

(60) Provisional application No. 60/805,808, filed on Jun. 26, 2006.

(51) Int. Cl.
*B25B 13/50* (2006.01)

(52) U.S. Cl. ..... 81/57.18; 81/57.33

(58) Field of Classification Search ..... 81/57.15–57.21, 81/57.33–57.34

See application file for complete search history.

(56) References Cited

U.S. PATENT DOCUMENTS

| | | | | |
|---|---|---|---|---|
| 4,572,036 | A * | 2/1986 | Renfro | 81/57.2 |
| 4,593,584 | A | 6/1986 | Neves | |
| 4,649,778 | A * | 3/1987 | Bottoms | 81/57.33 |
| 5,144,868 | A | 9/1992 | Feigel, Jr. | |
| 5,535,645 | A | 7/1996 | Penisson | |
| 5,904,075 | A * | 5/1999 | Buck | 81/57.18 |
| 6,058,811 | A | 5/2000 | Stuart | |
| 6,279,436 | B1 | 8/2001 | Walters | |
| 6,761,090 | B2 | 7/2004 | Dagenais et al. | |

* cited by examiner

*Primary Examiner*—D. S Meislin
(74) *Attorney, Agent, or Firm*—Sheema Khan Miltons IP/p.i.

(57) ABSTRACT

An open-throat power tong for making up or breaking apart an oilfield tubular connection, includes a cage plate lock system. The lock system connected to each cage plate extends across the space provided by the open throat in the cage plate when locked in the closed position. This provides support for the cage plates, resisting their tendency for expansion. The cage plates are mounted on the ring gear for rotation about a common center. The support provided to the cage plates for resisting expansion is communicated to the ring gear, thus providing support to the ring gear against expansion.

7 Claims, 5 Drawing Sheets

POWER TONG CAGE PLATE LOCK SYSTEM

REFERENCE TO RELATED APPLICATIONS

This application claims the benefit of priority to U.S. Provisional Patent Application Ser. No. 60/805,808, filed Jun. 26, 2006. The subject matter of this earlier filed application is hereby incorporated by reference.

FIELD OF THE INVENTION

This invention relates to the field of power tongs, in particular, improvements to open-throated power tongs used in oil-field applications.

BACKGROUND TO THE INVENTION

It is frequently necessary in oil field operations to connect or disconnect lengths of drill pipe which are threaded together at their joints. Power tongs replace the old system of wrapping a chain five or six times around drilling pipe and then pulling on the chain in order to make-up or to break a threaded joint in a string of oil well drilling pipe. Power tongs contain multiple assemblies nested within each other to engage with the pipe and force the pipe to turn. A typical power tong includes a mechanism for gripping the external surface of a first pipe section and then rotating this first pipe section while the adjacent pipe section, to which it is connected, is held stationary or rotated in the opposite direction.

The outer frame of an open-throated power tong is held stationary, typically by being chained to the oilrig. This frame has a C-shaped access opening to receive pipe. In use, a gate is swung across the opening to close the gap and make the frame rigid. Some examples of power tongs with various types of gates to close the outer frame are U.S. Pat. No. 6,279,426, U.S. Pat. No. 6,058,811, U.S. Pat. No. 5,144,868, and U.S. Pat. No. 4,593,584. Inside the outer frame are sets of pivoting jaws contained within an internal, rotating ring gear, also C-shaped. This ring gear is forced to rotate through its geared outer periphery. The interior surface of the ring gear carries a camming surface, which, as the ring gear rotates with respect to the jaws, causes the jaws to swing inwardly to engage with a drill pipe, casing, tubing, or equivalent positioned therein.

Typically, such a power tong assembly includes top and bottom plates, cage plates, which are rotatably carried by the ring gear. These cage plates in turn carry hinge pins to support the pipe engaging jaws. The top and bottom cage plates are constrained, so that they are marginally free to rotate with respect to the ring gear when the jaws are not fully engaged with a drill pipe. Thus, when the ring gear is forced to rotate through its geared outer periphery while the cage plates and hinge pins thereon are constrained, the camming surface of the ring gear may advance the jaws for engagement with the drill pipe. Once the jaws have fully engaged the drill pipe, the constraints on the cage plates are removed, allowing the cage plates to move in unison with the ring gear and pipe engaged therein.

When the jaws have forcibly engaged a pipe, an outwardly-directed radial reaction force is applied by the jaws to the camming surface of the ring gear. This reaction force must be resisted by the face of the camming surface of the ring gear in order for a rotational torque to be applied to the drill pipe. The reaction force on the camming gear surface increases as the rotational torque requirement increases. The more rotational torque required, the greater the jaw pressure against the pipe and the greater the outwardly-directed force against the ring gear's camming surface. This reaction force will tend to spread the ring gear open. Under previously used moderate torque levels, the rotating gear structure has been made sufficiently stiff that this tendency to spread has been tolerable However, at extremely high torques, this tendency for spreading of the rotating gear increases. High torques are becoming increasingly common in the industry.

To resist such spreading, open-throated power tongs typically include containment rollers mounted either on each of the cage plates or within the frame of the tong to bear against and resist spreading of the ring gear. These containment rollers transfer the spreading force to the tong body, and in some cases the body is not sufficiently rigid to effectively restrict spreading to tolerable limits. It has therefore been recognized that additional means to resist spreading of the ring gear are needed.

In existing power tongs a door is pivotally connected to the tong frame or body adjacent a side of the open throat. This door is positioned to extend across the open throat when in the closed position, resisting the tendency for spreading to occur across the entire tong body.

U.S. Pat. No. 5,904,075, asserts that it describes a method of reducing transmission of spreading forces to the ring gear. In this reference, portions of the jaws are advanced into a hooked connection to each other so that a portion of the spreading forces developed by the hinge pins of the jaws are absorbed through the jaw contacts rather than being focused exclusively on the pivot pins. By this arrangement the jaw pivot pins are partially restrained against spreading by the hooked engagements extending between the jaws. This reduces the spreading forces that would otherwise be directed into the cage plate and ring gear.

The invention described in this patent helps to lower the outwardly-directed force acting on the ring gear by transmitting a portion of the load through the cage plates. But no support is provided to the cage plates to prevent such cage plates from spreading.

There remains a need for a power tong system that includes cage plates that are better able to resist spreading themselves as well as provide support for the ring gear to resist expansion when exposed to the large amounts of torque developed in modern power tongs.

The invention in its general form will first be described, and then its implementation in terms of specific embodiments will be detailed with reference to the drawings following hereafter. These embodiments are intended to demonstrate the principle of the invention, and the manner of its implementation. The invention in its broadest and more specific forms will then be further described, and defined, in each of the individual claims which conclude this Specification.

SUMMARY OF THE INVENTION

According to one aspect of the invention, a cage plate locking means is provided for spanning across the open throat of the cage plate to strengthen the cage plate from spreading under high loads. The locking means essentially 'closes' the cage plate mouth allowing higher radial forces to be supported within the cage plate and ring gear assembly. The cage plate locking mechanism opens to allow pipe to be inserted, but when closed, 'locks' and rotates with the cage plate.

In a preferred embodiment a power tong for rotating a pipe to make up or break up a threaded joint comprises a tong body having an open throat therein, a ring gear rotatably supported by the tong body, and twin cage plates rotationally mounted with respect to the ring gear on opposite sides of the ring gear. The cage plates are free to rotate with respect to the ring gear, but are constrained to maintain a center of rotation substantially corresponding to the center of the ring gear. According to this preferred embodiment of the invention, a cage plate locking means is connected to each cage plate adjacent a side of the open throat in the cage plate to extend across the open throat when locked in a closed position and to expose the open throat of the power tong when in an opened position to enable the power tong to be moved laterally on or off the pipe. Alternatively, the power tong may engage a casing, tubing, or equivalent.

In one embodiment the cage plate locking means includes a pair of linking arms each respectively connected to the outer faces of the top and bottom cage plates. Optionally, these linking arms may be connected by a joining bar or other means to be swung in unison. Each of the locking arms includes a removable engagement means to secure the locking arm to the outer surface of the respective cage plates when swung into their closed position. Optionally, the two locking arms carry hooked portions at one of their respective ends and the respective cage plates each carry pin means extending from each cage plate for engagement with the corresponding hooked portions of the respective locking arms.

Actuation means, optionally in the form of a hydraulic cylinder seated on the outer face of either cage plate, may swing the locking arms between open and closed positions. Alternatively, the hydraulic cylinder may be seated on the tong body.

The cage plate locking means of the invention provides support to the cage plates, resisting expansion of the cage plates about the open throat formed therein. The cage plates of the invention are also mounted to the ring gear preferably through a friction-minimizing ring and track coupling. This coupling enables the cage plate to supply support to the ring gear, thereby resisting part of the spreading forces that would otherwise be borne by the ring gear. By reducing the tendency for expansion, the cage plates in a power tong according to the invention are better able to support the ring gear against expansion.

The foregoing summarizes the principal features of the invention and some of its optional aspects. The invention may be further understood by the description of the preferred embodiments, in conjunction with the drawings, which now follow.

DESCRIPTION OF THE PREFERRED EMBODIMENT

Figure 1:
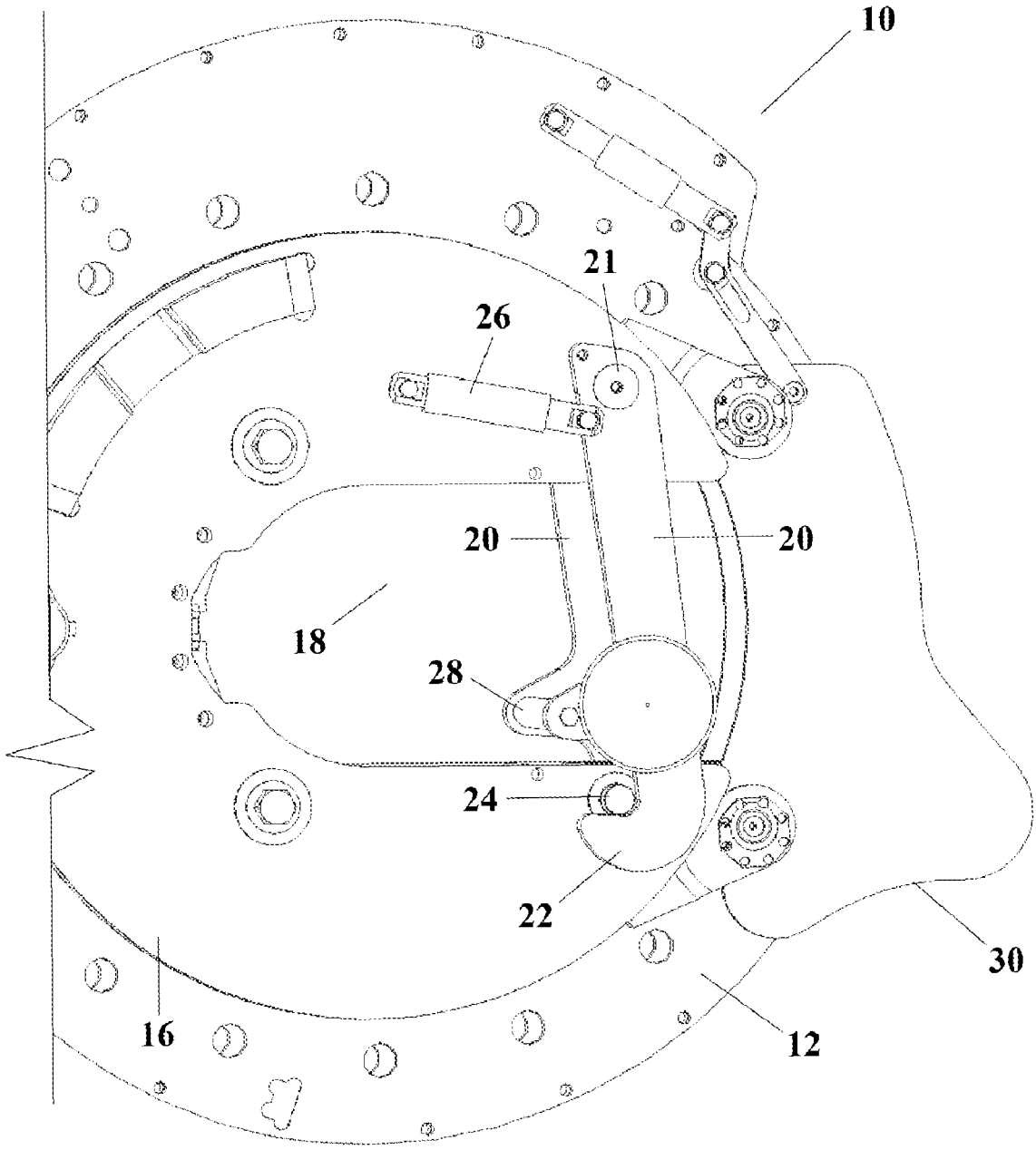
FIG. 1 is a top view of the power tong with the cage plate lock system in the closed position.
Figure 2:
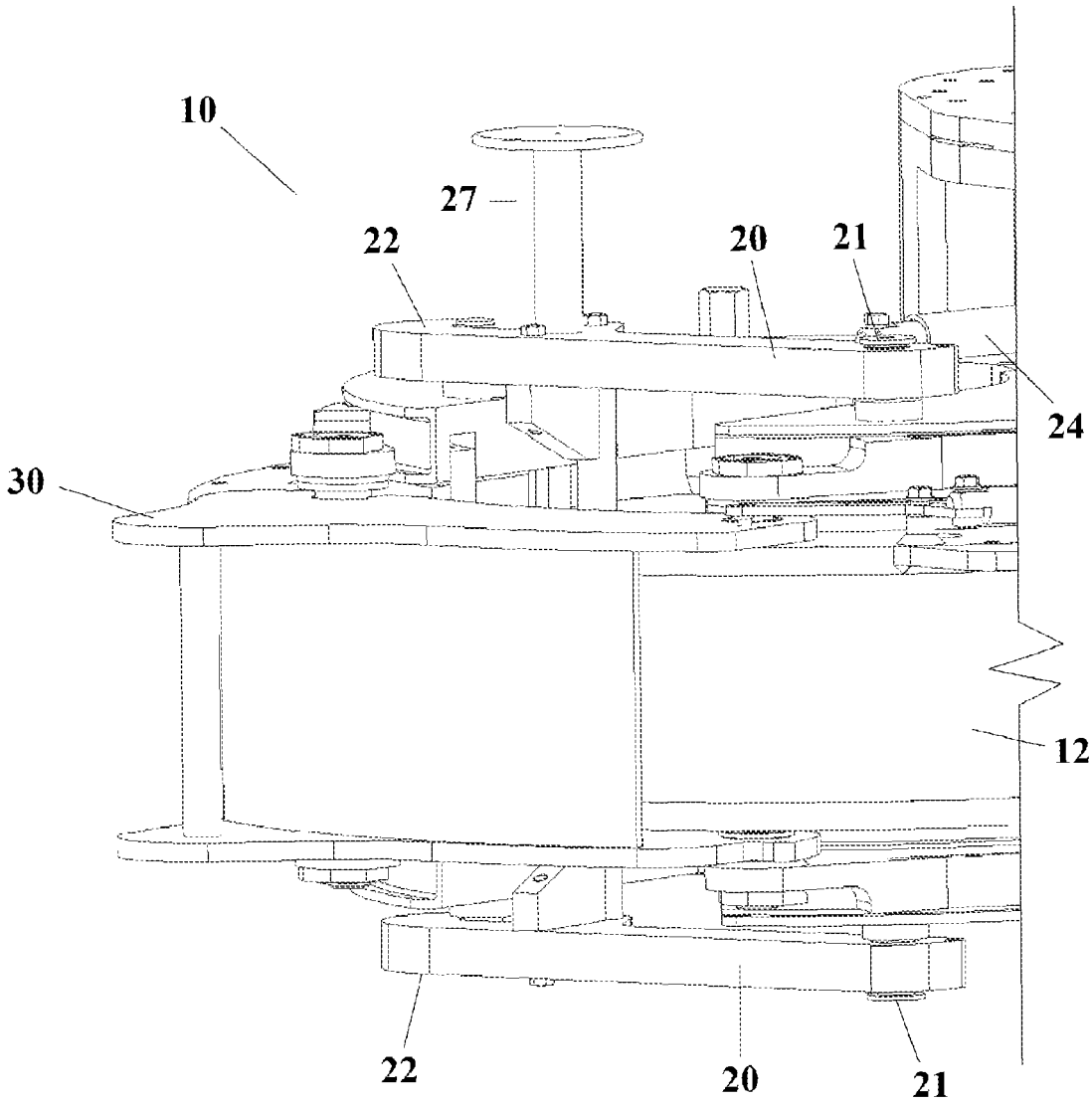
FIG. 2 is a side view of the power tong from FIG. 1.

As shown in FIGS. 1-4, the power tong 10, includes a tong body 12, a ring gear 14, and a pair of cage plates 16 having an open throat portion 19. Secured to each cage plate 16 is the cage plate lock system 18.

Figure 3:
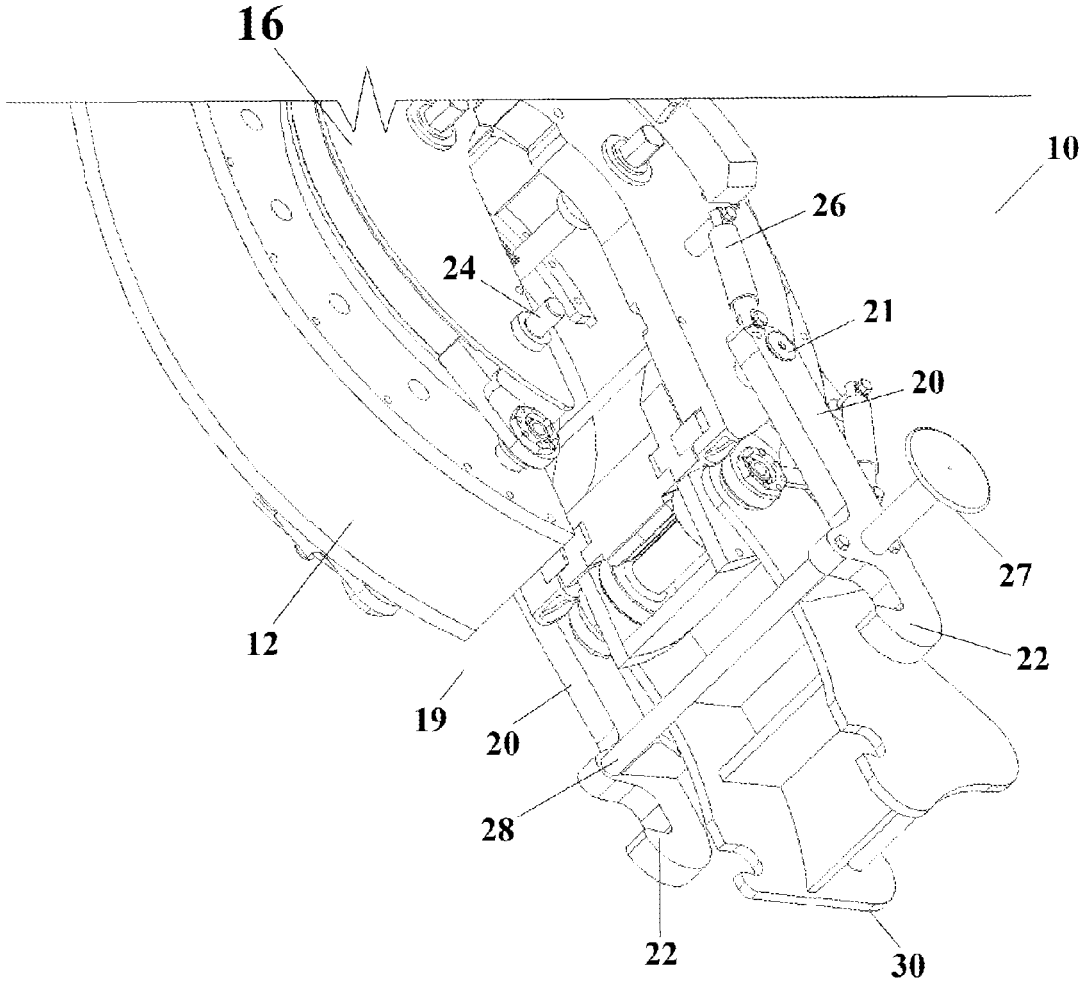
FIG. 3 is a perspective view of the power tong with the cage plate lock system in the open position.

As can be seen in FIGS. 1 and 3, the cage plate lock system 18 further includes a pair of locking arms 20. Each of the locking arms 20 is respectively rotatably secured at one end to the outer surface of a cage plate 16 as shown in the form of a securing pin 21. The locking arms 20 are free to rotate between the closed position seen in FIGS. 1 and 2, and the open position shown in FIG. 3. At the other end of each locking arm 20 is a hook member 22, which is dimensioned and positioned to removably engage with a pin 24 positioned on the outer surface of the cage plate 16, on the opposite side of the open throat 19. Once the locking arms 20 of this locking system 18 are engaged, they serve to secure the cage plates 16 against expansion under high torques.

As can be best seen in FIG. 3, a joining bar 28 connects between each locking arm 20, to allow the top and bottom locking arms 20 to be moved as one complete system. Actuation means, shown in the form of a spring cylinder 26 is seated on the outer face of either cage plate 16 and coupled to at least one of the linked locking arms 20 to forcibly maintain the locking arms 20 in either an open or closed position An operator may change the position of the locking arms 20 by using handle 27 positioned thereon.

A gate 30 is connected to the tong body 12 and is able to rotate from an open to a closed position, to allow a pipe (not shown) to enter through the open throat 19, and then be secured inside. The gate 30 serves to prevent spreading of the tong body 12. The cage locking arms 20 of the plate lock system 18 are attached to the cage plates 16 so that, upon disengagement, the joining bar 28 is able to swing clear of the path of the throat 19, resting against gate 30 when it is fully open, as shown in FIG. 3. During its closing swing, the gate 30 may be used to force the cage plate locking arms 20 into a closed position from an open position by bearing against the joining bar 28.

When the gate 30 and the cage plate lock system 18 are in the open position, a pipe with a threaded joint needed to make up or break up may be placed within the open throat 19 of the power tong 10. Once the pipe is placed inside, the gate 30 and the cage plate lock system 18 are then rotated and secured in the closed position seen in FIG. 1.

Figure 4:
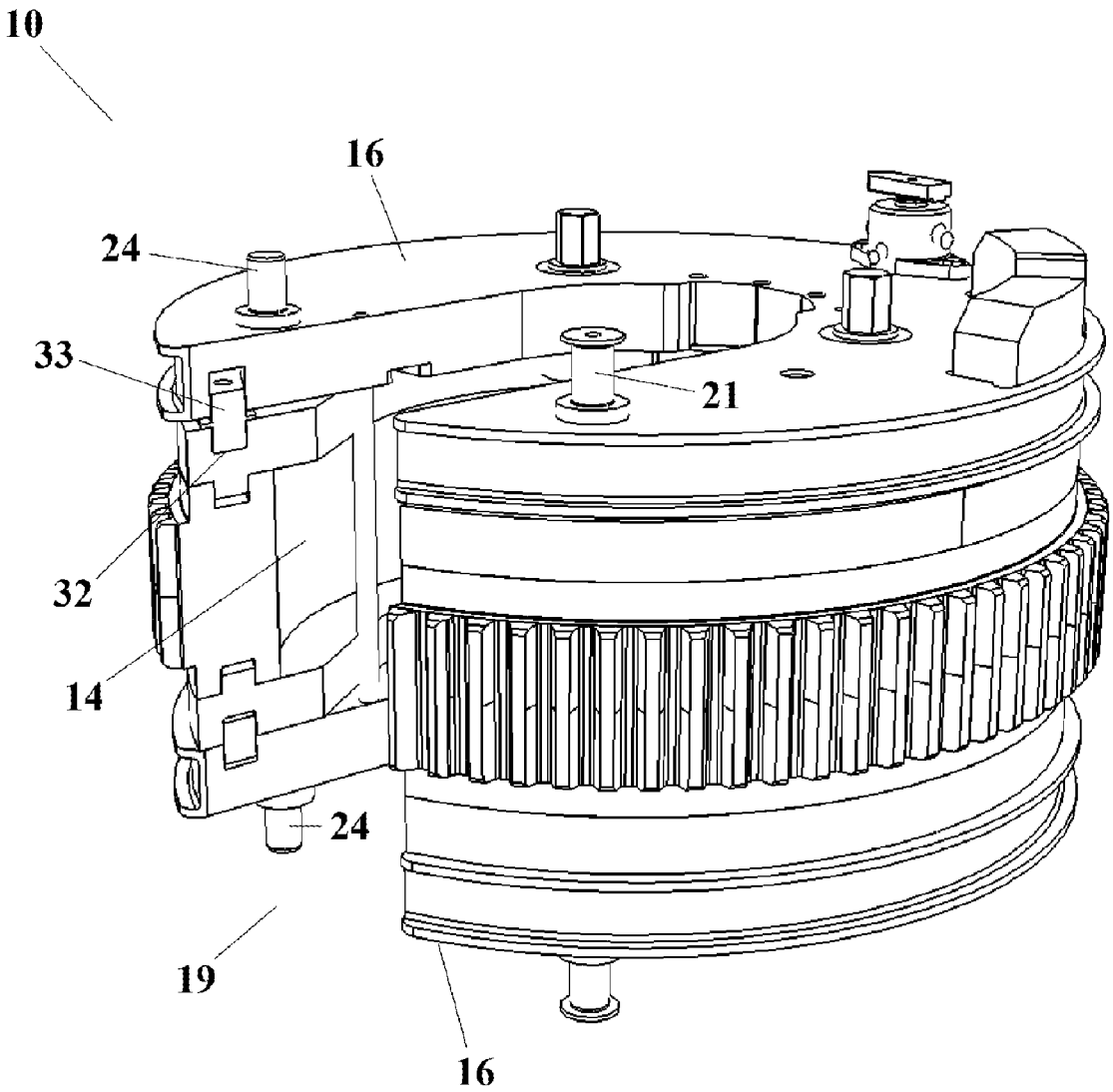
FIG. 4 is an isometric side view of the power tong showing the rail and groove connection between the cage plates and the ring gear.

The cage plates 16 are coupled to the ring gear 14 through a friction-minimizing groove 32 and rail 33 arrangement. As shown in FIG. 4, the groove 32 is formed in the top surface of the ring gear 14, and a track or rail 33 protrudes into the groove 32 from an adjacent cage plate 16. This configuration may be reversed with the groove 32 being present in the cage plate 16 etc. In order to minimize friction, the ring or rail 33 may be made of a different material, e.g. brass or bronze, which has a reduced tendency to frictionally engage with the steel sides of the groove. Alternately, one or the other of the cage plates 16 or ring gear 14 may carry rollers that engage against a surface carried by the other part. Through this coupling, the cage plates 16 provide support for the ring gear 14, absorbing part of the spreading forces that would otherwise be applied to the ring gear 14.

Accordingly, the use of the locking means 18 to constrain expansion of the cage plates 16 provides an indirect means for supporting the ring gear 14 against expansion.

Figure 5:
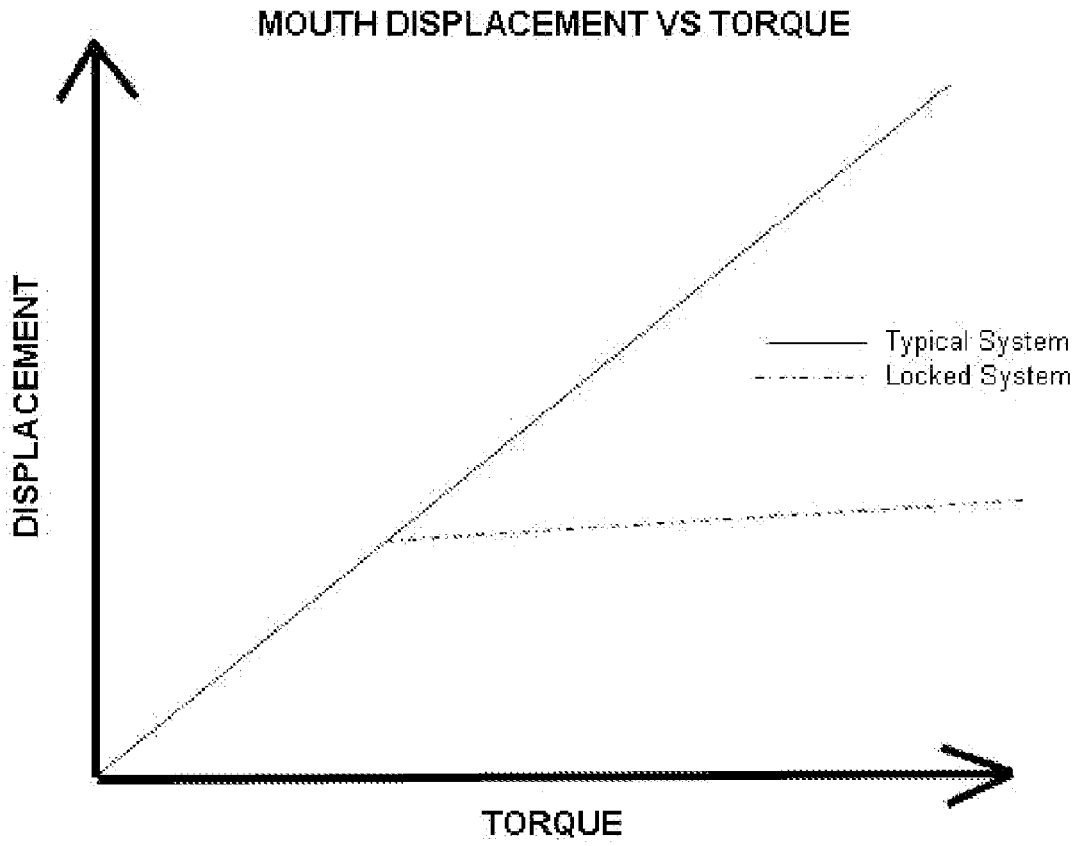
FIG. 5 is a chart showing the relationship between mouth displacement and torque.

The throat 19 of the ring gear 14 in a power tong 10 actually widens under high torque to a measurable degree. FIG. 5 compares a prior art power tong without a cage plate locking system 18 with the power tong in accordance with the invention. While not based upon actual measurements, FIG. 5 shows a projection of the general direction of the effect of the cage plate locking means 18, as described herein. With higher radial forces the mouth of a conventional cage plate/retaining gear assembly continues to spread in an essentially linear fashion with torque. With the invention present, this trend is arrested after it is only partially developed. This permits a power tong 10 to be used under higher torque conditions.

The invention has the alternate advantage of allowing the use of a lighter ie. thinner, cage plate 16 and/or a lighter ring gear 14 for a given torque than would otherwise be employed.

CONCLUSION

The foregoing has constituted a description of specific embodiments showing how the invention may be applied and put into use. These embodiments are only exemplary. The invention in its broadest, and more specific aspects, is further described and defined in the claims which now follow.

These claims, and the language used therein, are to be understood in terms of the variants of the invention which have been described. They are not to be restricted to such variants, but are to be read as covering the full scope of the invention as is implicit within the invention and the disclosure that has been provided herein.

We claim:

1. A power tong for rotating a pipe to make up or break up a threaded joint, comprising:

a) a tong body having a center point and a tong body open throat;

b) a ring gear rotatably supported by the tong body and having a ring gear open throat formed therein, the ring gear being positionable about the center point for alignment of the ring gear open throat with the tong body open throat;

c) twin cage plates rotationally mounted with respect to the ring gear on opposite sides of the ring gear, the cage plates each having a cage plate open throat formed therein that is positionable for alignment with the tong body open throat, said cage plates being free to rotate with respect to the ring gear about the center point, but being constrained to maintain a center of rotation substantially corresponding to the center point ; and d) a cage plate locking means connected to an outer surface of each cage plate adjacent a side of the respective cage plate open throat therein, such cage plate locking means being positionable to extend from one side of the open throat of the cage plate across to the other side of the open throat of the cage plate for restraining the open throat of the cage plate from expansion, thus providing resistance to expansion of the ring gear when the power tong is engaging a pipe.

2. The power tong as claimed in claim 1, wherein the cage plate locking means comprises two locking arms that are coupled by coupling means to swing in unison across the open throats of the two cage plates.

3. The power tong as claimed in claim 2, wherein the two locking arms each carry a removable engagement means to secure each locking arm to the outer surface of the respective cage plates when the cage plate locking system is in the closed position.

4. The power tong as claimed in claim 3, wherein the removable engagement means comprises hooked portions carried by the locking aims at one of their respective ends and the respective cage plates each carry pin means extending from each cage plate for engagement with the corresponding hooked portions of the respective locking arms when the cage plate locking system is in the closed position.

5. The power tong as claimed in claim 4, comprising actuation means for positioning the locking arms respectively in closed and opened positions.

6. The power tong as claimed in claim 2 wherein the locking arms and coupling means are positioned on the power tong to swing clear of the power tong open throat when the locking arms are in their open position.

7. The power tong as claimed in claim 1 wherein the cage plates are mounted to the ring gear through a friction-minimizing ring and track coupling to enable the cage plate to supply support to the ring gear, thereby absorbing part of the spreading forces that would otherwise be applied to the ring gear.

* * * * *